United States Patent [19]

Karls

[11] 3,950,971

[45] Apr. 20, 1976

[54] EXPANSION PLUG LOCK

[75] Inventor: Albert J. Karls, Greenville, Miss.

[73] Assignee: Moeller Mfg. Co., Inc., Greenville, Miss.

[22] Filed: Dec. 4, 1974

[21] Appl. No.: 529,557

[52] U.S. Cl. ..... 70/164; 70/212; 215/207

[51] Int. Cl.[2] ..... B65D 55/14

[58] Field of Search ..... 70/164, 167, 203, 212, 70/230; 215/207, 212; 220/214, 235, 236, 237

[56] References Cited

UNITED STATES PATENTS

| | | | |
|---|---|---|---|
| 1,065,896 | 6/1913 | Carter | 215/207 |
| 1,371,886 | 3/1921 | Gage | 70/203 |
| 2,566,816 | 9/1951 | Work | 220/210 |
| 3,812,810 | 5/1974 | Moeller | 114/197 |

*Primary Examiner*—Albert G. Craig, Jr.
*Attorney, Agent, or Firm*—Berman, Aisenberg & Platt

[57] ABSTRACT

A lockable closure plug consisting of a top-flanged cylindrical resilient compressible body with a top plate covering the top of the body and a flat bottom plate engaging the bottom of the body, and an axial operating stem rotatably engaging centrally through the body and abutting on the top plate and threadedly engaged through a nut secured centrally to the bottom plate. A rod-like handle bar is secured perpendicularly through the top end of the stem and a pair of link bars are pivoted to opposite sides of an upstanding U-shaped bracket on the top plate. The link bars in raised positions can lockingly receive the handle bar therebetween, and said link bars are apertured to receive the hasp of a padlock, which can hold the link bars in raised locking positions. The link bars have end stop lug portions near their pivot points, the lug portions being engagable with the top plate to prevent the link bars from being rotated outwardly away from the handle bar, thus preventing the handle bar from being unlocked unless the padlock is removed. Without the padlock, the link bars can assume normal lowered positions on opposite sides of the stem below the level of the handle bar, allowing the stem to be rotated.

7 Claims, 6 Drawing Figures

EXPANSION PLUG LOCK

This invention relates to expanding closure plugs or stoppers, and more particularly to closure plugs provided with locking means to prevent unauthorized removal of the plugs.

A main object of the invention is to provide a novel and improved lockable closure plug which is relatively simple in construction, which is easy to operate, and which can be securely locked so that it cannot be removed by unauthorized individuals.

A further object of the invention is to provide an improved lockable closure plug of the expansion type which involves inexpensive components, which can be readily inserted in a closure opening and adjusted to sealing position, and which can be then locked by means of a conventional padlock, or the like, so that it cannot be unfastened and removed by unauthorized persons.

A still further object of the invention is to provide an improved lockable closure plug which can be employed for a wide variety of uses, such as for sealing openings of various types, including those in assorted containers as well as those in conduits, boat drains, floor drains and the like, where it is necessary to be able to remove the closure plug at times and where it is necessary to at times lock the closure plug so that it cannot be removed by unauthorized persons, the improved closure plug being rugged in construction, being easy to operate, being usable in relatively restricted locations, such as in the recessed wall of a gasoline tank, or similar receptacle, and being highly effective in preventing unauthorized removal thereof.

A still further object of the invention is to provide a novel and improved locking means for a closure plug of the type having a rotatable operating stem, the locking means involving the use of a conventional padlock, which, when removed, allows the locking means to assume an inoperative position permitting the operating stem to be rotated, but which when in elevated position and engaged by the hasp of the padlock, positively prevents rotation of said operating stem.

Further objects and advantages of the invention will become apparent from the following description and claims, and from the accompanying drawings, wherein:

Figure 1:
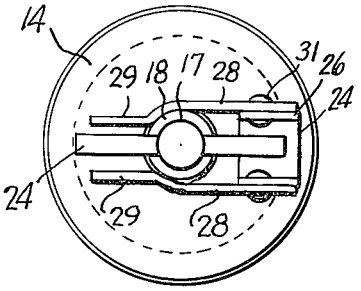
FIG. 1 is a top plan view of an improved lockable closure plug assembly constructed in accordance with the present invention, shown with its locking arm means in normal lowered inoperative position.
Figure 4:
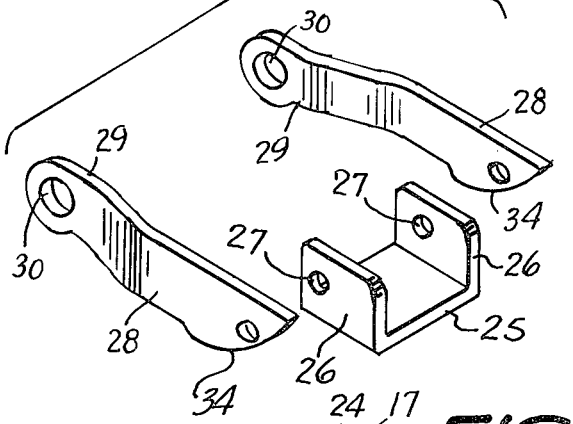
FIG. 4 is an enlarged perspective view showing the locking link arms and associated pivot bracket employed in the lockable closure plug assembly of FIGS. 1 to 3, the link arms and bracket being shown in separated positions.

Referring to the drawings, 10 generally designates an improved lockable closure plug assembly constructed in accordance with the present invention. The closure plug assembly 10 comprises a conventional plug 11 having a cylindrical resilient compressible main body 12 formed integrally with a top flange 13, which may be of any suitable expansible resilient material, such as rubber, neoprene, or the like. A circular rigid outer compression plate 14 is engaged on and substantially covers the top flanged portion of the body, and a smaller rigid generally circular compression plate 15 underlies the bottom end of the body.

The main portion of body 12 is formed with ribs or corrugations 16 for improving the sealing action of the body and for permitting free expansion thereof when subjected to compression between the top and bottom compression plate members 14 and 15, as will be presently described. The body 12 is in the form of a shell with substantial wall thickness, but which is readily expansible laterally when subjected to squeezing pressure between top and bottom plates 14 and 15.

Designated at 17 is an operating stem which extends axially through the plate elements 14, 15 and the intervening bottom member 12 and which is provided with an enlarged abutment portion 18 bearing on an abutment washer 19 engaging on the central portion of top plate 14. The portion of stem 17 below abutment shoulder 18 is reduced and threaded, as shown at 20 and is threadedly engaged through a nut 21 rigidly secured centrally to the circular bottom plate 15. The lower end of threaded portion 20 may be suitably deformed, as shown at 22, to prevent its complete disengagement from the fixed nut element 21.

Figure 5:
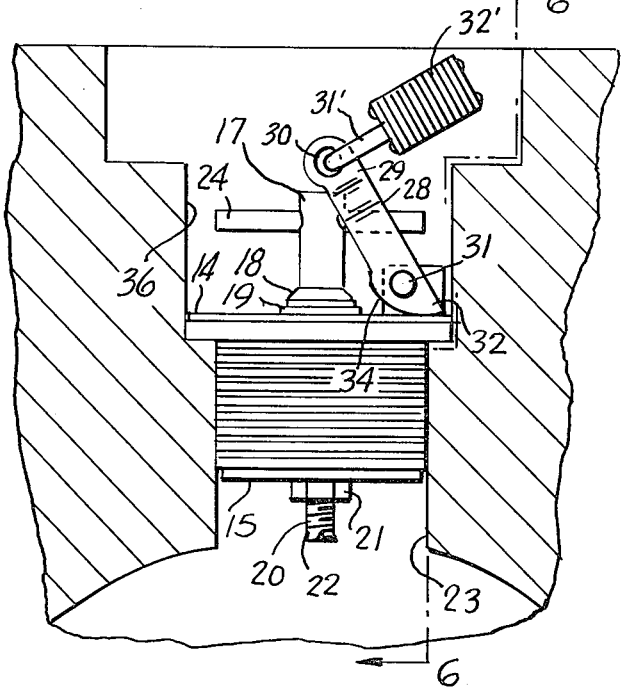
FIG. 5 is a vertical cross sectional view taken through the top opening of a typical fuel storage tank, showing the use of a lockable closure plug such as that illustrated in FIGS. 1 to 4, with the closure plug locked in sealing position.

As will be readily understood, rotation of the stem member 17 in one direction applies squeezing pressure to the rigid compression plate elements 14 and 15, to thereby cause the corrugated main body portion of the plug assembly to expand and to exert sealing force against the inside surface of a plug opening, such as the tank opening 23 shown in FIG. 5, whereas rotation of the stem 17 in the opposite direction releases the resilient body and allows it to resume its normal diameter, which allows the plug to be removed from the closure opening 23. Thus, the stem member 17 is provided with a rod-like handle bar member 24 which extends through and which is secured to the top portion of the stem member and which is employed as a handle for rotating same.

Figure 6:
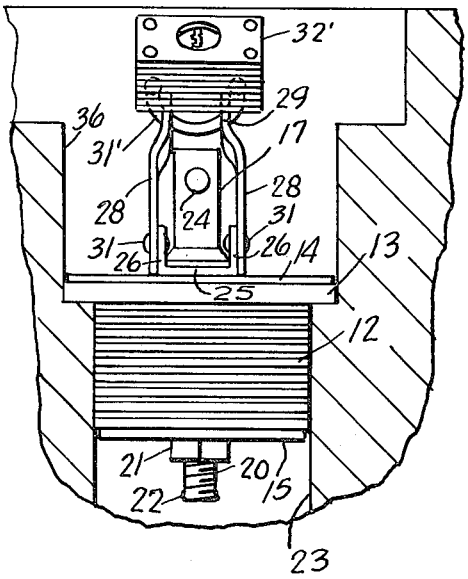
FIG. 6 is a vertical cross sectional view taken substantially on the line 6—6 of FIG. 5.

Rigidly secured on top plate member 14 and spaced laterally from stem member 17 of the conventional plug 11 is a U-shaped bracket member 25 having upstanding side flanges 26, 26, the U-shaped bracket member 25 being substantially radially aligned with the stem member 17 so that the planes of the upstanding flanges 26, 26 are parallel to and extend on opposite sides of the vertical axis of stem member 17. The forward portions of the flanges 26, 26 are formed with pivot holes 27, 27 in which respective locking link arms 28, 28 are pivotally mounted by rivets 31. As shown in FIG. 5, the link arms 28, 28 may be elevated to positions wherein the handle bar 24 is received therebetween. In the form shown in FIG. 5, these positions include an angle of rotation of the link arms of about 45° to 90° with respect to the plate element 14 depending upon the configuration of the stop lugs. Thus, these link arms 28, 28 are employed for locking the stem member 17 against rotation when it is desired to lock the assembly. The arms 28, 28 are formed with inwardly offset top portions 29, 29 which are formed with apertures 30 adapted to receive the hasp 31' of a conventional padlock 32' to thereby lock the arms 28 in elevated positions such as those shown in FIGS. 5 and 6, with the handle bar element 24 received therebetween. To limit the elevation of the link arms 28 to positions such that they will always receive the handle bar 24 therebetween, the link arms are formed adjacent to their pivotal connections or rivets, shown at 31, with stop lug elements 32 which are engagable with top plate element 14 to prevent clockwise rotation of the link arms 28, as viewed in FIG. 5, beyond the locking positions of said link arms, namely, to prevent the link arms 28, 28 from being rotated outwardly beyond the end of the handle bar 24.

Figure 2:
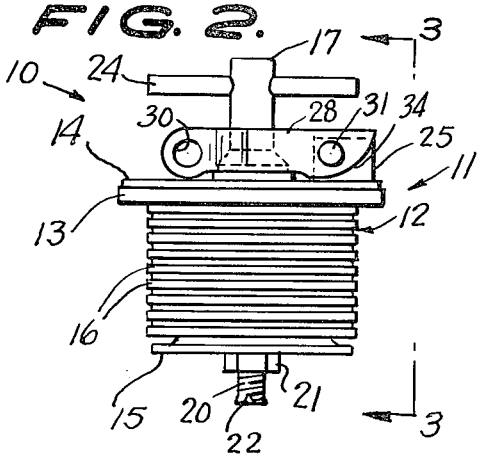
FIG. 2 is a side elevational view of the lockable closure plug of FIG. 1.
Figure 3:
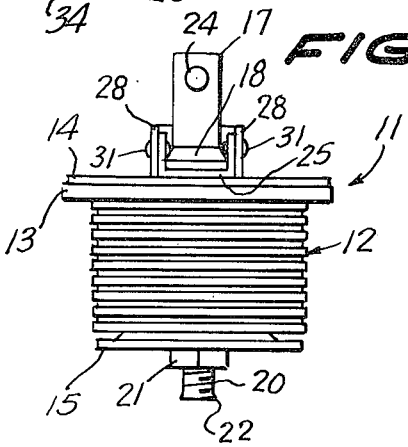
FIG. 3 is an end elevational view of the closure plug assembly of FIGS. 1 and 2, taken substantially on line 3—3 of FIG. 2.

The bottom edge portions of the link bars 28 are arcuately curved inwardly adjacent to the stop lug portions 32, as shown at 34 to provide clearance to permit the link bars 28, 28 to assume normal lowered positions, such as those shown in FIG. 2, resting on the top plate 14 and located below the level of the handle bar 24, so that the handle bar 24 may be turned to rotate the stem member 17.

It will be further noted that the provision of the stop lugs 32 assures that the link arms 28 will be restrained to positions within the clearance provided by the intermediate restricted recessed portion 36 in the typical tank opening shown in FIG. 5. In using the closure plug assembly 10, it is first inserted in the usual manner in the closure opening 23 with the resilient body 12 in a non-expanded condition, to allow easy insertion thereof in the opening 23. With the body 12 in its seated position, such as shown in FIG. 5, the handle bar 24 is then rotated in a direction to exert squeezing pressure on the plate members 14 and 15 and to thereby expand the ribbed sealing portion of body 12 so as to make tight sealing contact with the inside surface of the closure opening 23. When the desired degree of compression has been applied to body 12, the handle bar 24 is rotated to a position aligned with the bracket 25 and the link arms 28, 28 are elevated to positions such as those shown in FIGS. 5 and 6, at which point the hasp 31' of the conventional padlock 32' is engaged through the apertures 30, 30. Hasp 31' is then engaged in the padlock 32'. As shown in FIG. 5, with the padlock thus locking the link arms 28 in elevated positions, said link arms cannot drop back below the handle bar member 24 and, therefore, with the handle bar 24 thus received between the link arms 28, 28, the stem member 17 cannot be rotated. This prevents unauthorized removal of the closure plug assembly, the only person able to unlock said assembly being one having the key to the padlock 32'.

As above explained, the lug elements 32 assure that the link arms 28, cannot be rotated away from the handle bar 24 to allow unauthorized rotation of the handle bar 24. Although the typical installation shown in FIGS. 5 and 6 involves a restricted enclosure 36, in many other applications there is no such restriction, and it is therefore necessary to insure that the link bar elements 28 cannot be rotated away from the handle bar element 24 when the link arms are locked in the manner above described.

It is contemplated that one link arm may be used in place of two. Also, where two link arms are employed, a stop lug may be located on either or both link arms.

It will also be readily apparent that the lockable closure plug assembly 10, as above described, can be employed anywhere it is desired to seal an opening, such as with liquid tanks, conduits, boat and floor drains, or any other situation where it is necessary to be able to remove the closure plug at times, and where it is necessary to at other times lock the closure plug so that it cannot be removed by unauthorized persons. Thus, it can be used as a closure plug for gasoline or other fuel tanks, as a boat bailer plug, as a pipe plug, or as a dip-stick plug, which are typical examples of circumstances where it is important to prevent unauthorized removal of the closure plug.

While a specific embodiment of an improved lockable closure plug assembly has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A lockable closure plug comprising a resilient compressible body, inner and outer compression elements engaging the opposite ends of the body, an axial stem member extending through the compression elements and said body, means to exert squeezing pressure on said compression elements responsive to movement of said stem member, a transversely extending handle on said stem member, locking means on said plug adjacent said handle comprising a pair of link arms extending transversely of said stem member with said stem member located between said arms, said link arms being mounted for longitudinal movement with respect to said stem member, said link arms being spaced apart substantially throughout their entire length to receive said stem whereby said arms are movable from a non-locking position out of the path of movement of said handle to a locking position wherein said arms are in the path of movement of said handle.

2. The lockable closure plug of claim 1 wherein each of said link arms is apertured at one end whereby a locking member may be inserted therethrough to hold the arms in their locking position in the path of movement of said handle.

3. The lockable closure plug of claim 1, and stop means to limit the movement of said link arms when moved to a locking position.

4. The lockable closure plug of claim 3, wherein said stop means comprises abutment means on the link arms engagable with the adjacent compression element.

5. The lockable closure plug of claim 4, wherein said last named adjacent compression element is provided with an upstanding projection, and said link arms are pivoted on a common transverse axis to said projection.

6. The lockable closure plug of claim 1, wherein said link arms are mounted for movement independent of each other.

7. The lockable closure plug of claim 6, wherein each of said link arms has one end pivotally connected to the adjacent compression element and has its other end apertured whereby a locking member may be inserted therethrough to hold the arms in their locking position in the path of movement of said handle.

* * * * *